US008137128B2

(12) United States Patent
Hsueh et al.

(10) Patent No.: US 8,137,128 B2
(45) Date of Patent: Mar. 20, 2012

(54) SATA ELECTRICAL CONNECTOR AND ASSEMBLY THEREOF

(75) Inventors: Chih Yu Hsueh, Taipei Hsien (TW); Jie Chen, Taipei Hsien (TW)

(73) Assignee: Ant Precision Industry Co., Ltd., Tu-Chen, Taipei Hsien (TW)

( * ) Notice: Subject to any disclaimer, the term of this patent is extended or adjusted under 35 U.S.C. 154(b) by 0 days.

(21) Appl. No.: 13/114,661

(22) Filed: May 24, 2011

(65) Prior Publication Data

US 2011/0223811 A1 Sep. 15, 2011

Related U.S. Application Data

(62) Division of application No. 12/636,172, filed on Dec. 11, 2009.

(30) Foreign Application Priority Data

Aug. 10, 2009 (TW) ..... 98214706 U

(51) Int. Cl.
*H01R 12/24* (2006.01)

(52) U.S. Cl. ..... 439/499

(58) Field of Classification Search ..... 439/497, 439/499, 607.49, 483, 484
See application file for complete search history.

(56) References Cited

U.S. PATENT DOCUMENTS

| | | | |
|---|---|---|---|
| 6,331,122 | B1 | 12/2001 | Wu |
| 6,648,676 | B1 | 11/2003 | Lee |
| 6,827,612 | B2 | 12/2004 | Wu |
| 6,830,478 | B1 | 12/2004 | Ko |
| 6,832,931 | B1 | 12/2004 | Wu |
| 6,910,914 | B1 | 6/2005 | Spink, Jr. |
| 7,585,184 | B2 | 9/2009 | Su et al. |

*Primary Examiner* — Phuong Dinh
(74) *Attorney, Agent, or Firm* — Cheng-Ju Chiang

(57) ABSTRACT

A SATA electrical connector extends a lateral rib and a longitudinal guiding portion from a base surface of an insulator. The insulator and the terminals have intimate engagements, for minimizing height and width of the entire structure. The electrical connector can be joined to another electrical connector for forming an electrical connector assembly.

8 Claims, 7 Drawing Sheets

SATA ELECTRICAL CONNECTOR AND ASSEMBLY THEREOF

CROSS REFERENCE TO RELATED APPLICATIONS

This application is a Divisional of co-pending application Ser. No. 12/636,172, filed on 11 Dec. 2009, and for which priority is claimed under 35 U.S.C. §120; and this application claims priority of Application No. 098214706 filed in Taiwan on 10 Aug. 2009 under 35 U.S.C. §119; the entire contents of all of which are hereby incorporated by reference.

BACKGROUND

1. Field of the Invention

The present invention relates to a SATA (Serial Advanced Technology Attachment) electrical connector and its assembly, and more particularly, to a connector meet SATA standard and its assembly, suitable for high rate signal transmission and power transmission.

2. Description of the Related Art

A conventional electrical connector disclosed in Taiwan patent no. 510586 (U.S. Pat. No. 6,331,122) includes an insulative housing, a plurality of conductive terminals received in the insulative housing, and a pair of fasteners attached to opposite side surfaces of the insulative housing. The insulative housing has a pair of guiding poles and a pair of fixing portions extending beyond opposite sides of the insulative housing.

However, this kind of electrical connector is of high height, and also of large width because of the pair of guiding poles. Therefore, for the electronic product of limited inner space, there is a need for improvement to satisfy user's requirement.

BRIEF SUMMARY

The present invention provides a SATA electrical connector, by means of extending a lateral rib and a longitudinal guiding portion from a base surface of an insulator, and flat portions of each terminal extending beyond corresponding slots of the lateral rib, forming a first electrical connector.

The present invention also provides a SATA electrical connector, by means of defining a lateral slot and a longitudinal guiding slot in an insulator, and resilient portions of each terminals protruding beyond internal slots of the insulator, and a metallic housing having a supporting portion, forming a second electrical connector.

The present invention further provides a SATA electrical connector assembly. When a first electrical connector is disposed to a second electrical connector, a longitudinal guiding slot of the second electrical connector guides a longitudinal guiding portion of the first electrical connector, resulting a lateral rib of the first electrical connector being accurately inserted into a lateral slot of the second electrical connector.

The advantage of the present invention is, when the electrical characteristic is remain unchanged, the insulator and the terminals of the electrical connector will have intimate engagements, and the guiding poles of the conventional SATA electrical connector can be omitted for minimizing height and width of the entire structure.

The another advantage of the present invention is, the width of the power supply terminal is smaller than the width of the signal terminal, and a distance between adjacent power supply terminals is smaller than a distance between adjacent signal terminals, for further minimizing the width of the electrical connector.

Accordingly, in one aspect, the present invention is to provide a SATA electrical connector comprising an insulator having a lateral rib protruding from a base surface, and a longitudinal guiding portion extending from one side of the lateral rib; a signal terminal group having a plurality of signal terminals, a flat portion of each signal terminal being inserted into a signal terminal hole of the insulator; a power supply terminal group having a plurality of power supply terminals, a flat portion of each power supply terminal being inserted into a power supply terminal hole of the insulator; a cable having a first wire group and a second wire group, wires of the first wire group and the second wire group being respectively connected to the signal terminals and the power supply terminals; and a metallic housing clasped to a base of the insulator, wherein the flat portions of the signal terminals protrude beyond signal terminal slots of the lateral rib, and the flat portions of the power supply terminal protrude beyond power supply slots of the lateral rib thereby minimizing height and width of the entire structure.

In another aspect, the present invention is to provide a SATA electrical connector comprising an insulator defining a lateral slot and a longitudinal guiding slot extending from the lateral slot; a signal terminal group having a plurality of signal terminals, the signal terminals being inserted into signal terminal holes of the insulator; a power supply terminal group having a plurality of power supply terminals, the power supply terminals being inserted into power supply terminal holes of the insulator; and a metallic housing covering around the insulator, the metallic housing having a supporting portion, wherein resilient portions of the signal terminals protrude beyond internal signal terminal slots of the insulator, resilient portions of the power supply terminal protrude beyond internal power supply slots of the insulator.

In still another aspect, the present invention is to provide a SATA electrical connector assembly comprising a first electrical connector with a cable and a second electrical connector disposed on a printed circuit board, insulators of the first and the second electrical connectors inserted a plurality of terminals, terminals of the first electrical connector being electrically connected to wires of the cable, terminals of the second electrical connector being electrically connected to conductive portions of the printed circuit board, wherein the insulator of the first electrical connector has a lateral rib and a longitudinal guiding portion, the lateral rib is disposed to a lateral slot of the second electrical connector, and the longitudinal guiding portion is disposed to a longitudinal guiding slot of the second electrical connector; the flat portions of the terminals of the first electrical connector protrude beyond terminal slots of the lateral rib, and the flat portions contact with the terminals of the second electrical connector; and the metallic housing of the first electrical connector has a fixing plate, the fixing plate is clasped to a locating projection of the metallic housing of the second electrical connector, the metallic housing of the second electrical connector has a supporting portion.

The further advantage of the present invention is, the fixing plate of the first electrical connector is clasped to the locating projection of the second electrical connector. The supporting portion of the second electrical connector supports the first electrical connector. Therefore, when the first electrical connector is pulled out from the second electrical connector, the first electrical connector and the second electrical connector are prevented from being damaged.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
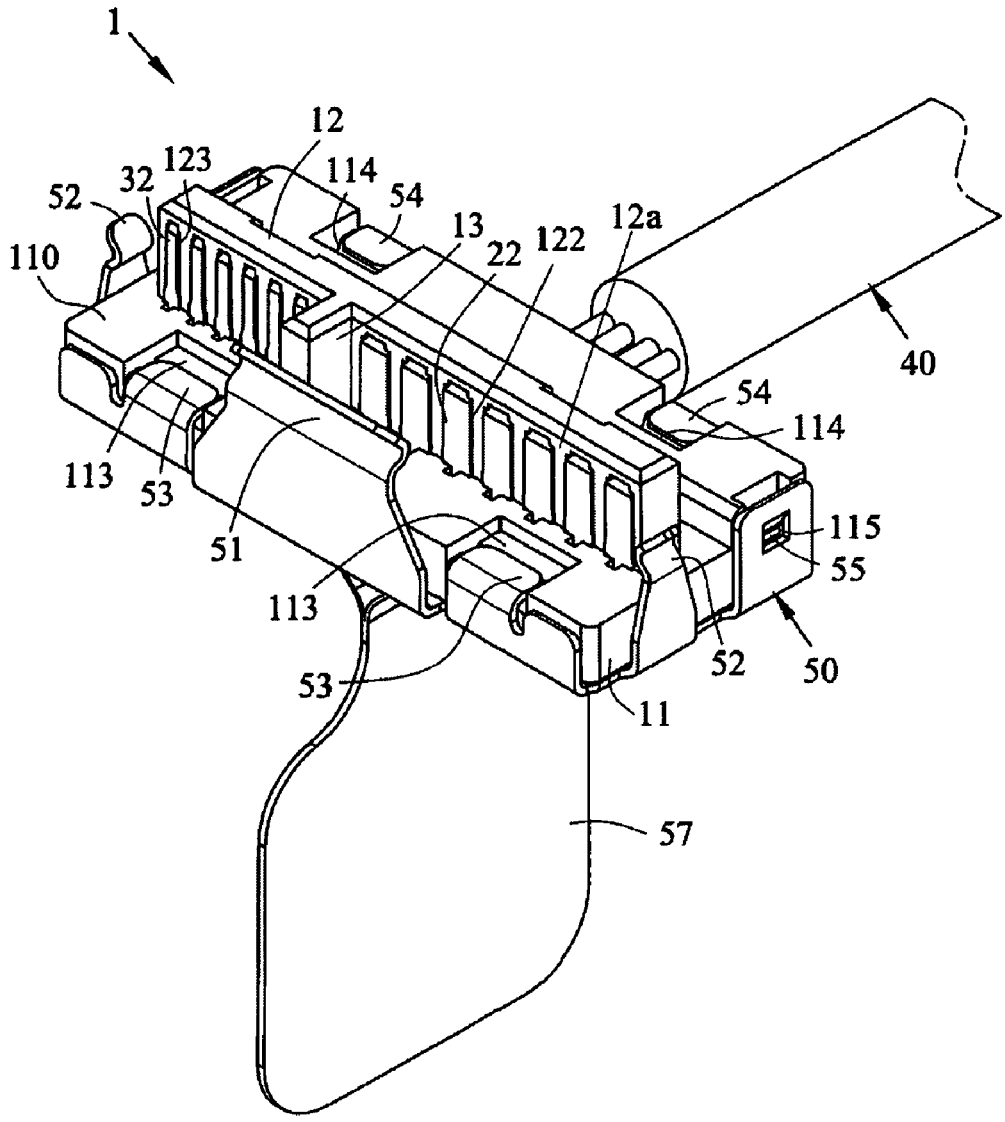
FIG. 1 is a schematic, three dimensional view of a first electrical connector of the present invention.
Figure 2:
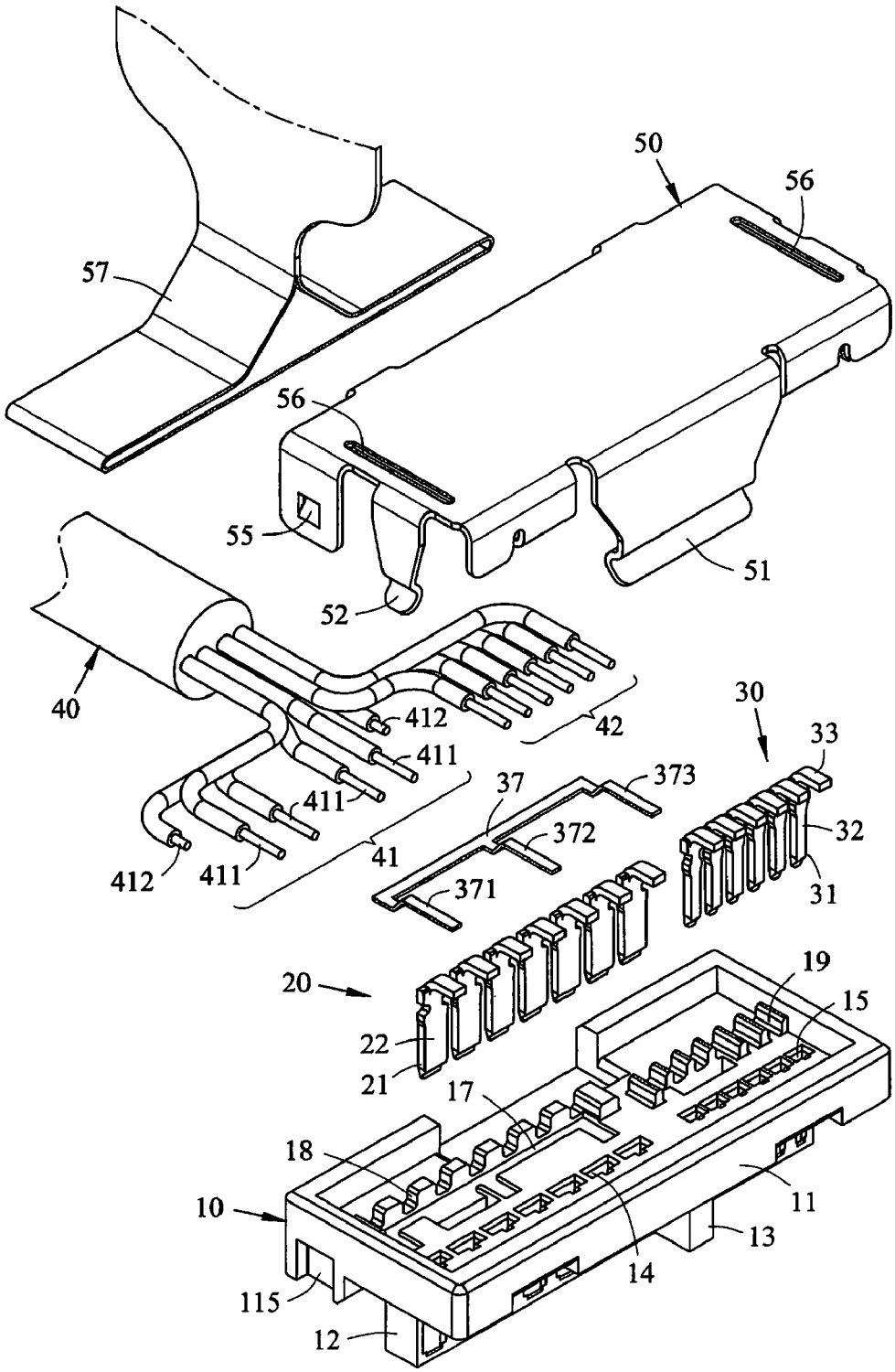
FIG. 2 is an exploded, three dimensional view of the first electrical connector of the present invention.
Figure 3:
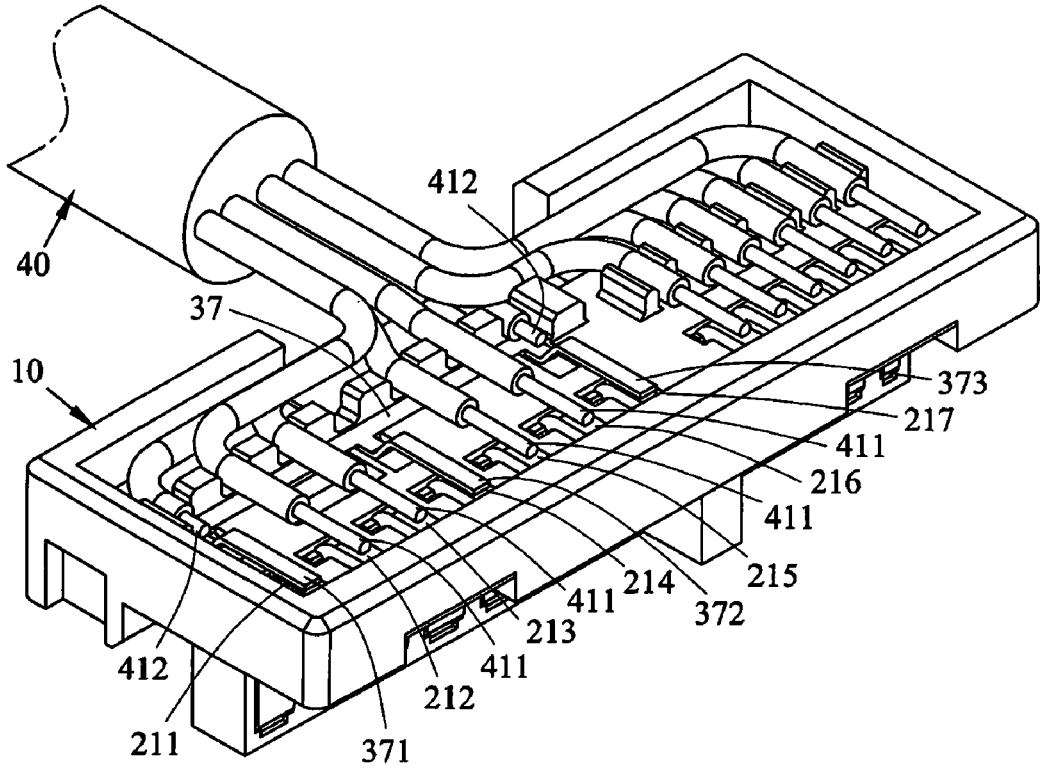
FIG. 3 is a three dimensional view shown wire connections of the first electrical connector.

Referring to FIGS. 1 to 3, a first connector 1 of the present invention includes an insulator 10, a signal terminal group 20, a power supply terminal group 30, a cable 40, and a metallic housing 50. The insulator 10 has a lateral rib 12 protruding from a base surface 110, and a longitudinal guiding portion 13 extending from one side of the lateral rib 12, wherein the guiding portion 13 is located between the signal terminal group 20 and the power supply terminal group 30. The signal terminal group 20 has a plurality of signal terminals 21, i.e., the first signal terminal, the second signal terminal, . . . , the seventh signal terminal. A flat portion 22 of each signal terminal 21 is inserted into a signal terminal hole 14 of the insulator 10. The power supply terminal group 30 has a plurality of power supply terminals 31, and a flat portion 32 of each power supply terminal 31 is inserted into a power supply terminal hole 15 of the insulator 10. In addition, the lateral rib 12 has a long side surface 12*a* and the guiding portion 13 connects to the long side surface 12*a* of the lateral rib 12, wherein the signal terminal holes 14 and the power supply terminal holes 15 are distributed along the long side surface 12*a* of the lateral rib 12 connected to the guiding portion 13. The cable 40 has a first wire group 41 and a second wire group 42. Wires of the first wire group 41 are respectively connected to the signal terminals 21 of the signal terminal group 20, and wires of the second wire group 42 are respectively connected to the power supply terminals 31 of the power supply terminal group 30. The metallic housing 50 is clasped to a base 11 of the insulator 10. The metallic housing 50 has a fixing plate 51 at a front end, and two grounding plates 52 at opposite sides, and two through holes 56 for allowing pulling plates 57 passing through. The flat portions 22 of the signal terminals 21 protrude beyond signal terminal slots 122 of the lateral rib 12, and the flat portions 32 of the power supply terminal 31 protrude beyond power supply slots 123 of the lateral rib 12. The metallic housing 50 has a plurality of fastening plates 53, 54 for respectively clasping in indentations 113, 114 of the base 11 of the insulator 10. The metallic housing 50 has a plurality of blocking plates 55 for respectively engaging with blocking portions 115 of the base 11 of the insulator 10. Therefore, when the electrical characteristic is remain unchanged, the insulator 10, the signal terminals 21 and the power supply terminals 31 have intimate engagements, and the height of the first electrical connector 1 is minimized to a mini SATA electrical connector. Furthermore, the longitudinal guiding portion 13 functions as the guiding structure, therefore, the guiding poles of the conventional SATA electrical connector can be omitted and the width of the first electrical connector 1 is accordingly minimized.

Referring to FIG. 2, in the signal terminal group 20 and the power supply terminal group 30, the width of the power supply terminal 31 is smaller than the width of the signal terminal 21, and a distance between adjacent power supply terminals 31 is smaller than a distance between adjacent signal terminals 21, for further minimizing the width of the first electrical connector 1.

Referring to FIGS. 2 and 3, the insulator 10 has a grounding terminal 37. A first extension portion 371 of the grounding terminal 37 is electrically connected to a bending portion 211 of the first signal terminal, while a second extension portion 372 of the grounding terminal 37 is electrically connected to a bending portion 214 of the fourth signal terminal, and a third extension portion 373 of the grounding terminal 37 is electrically connected to a bending portion 217 of the seventh signal terminal. The first wire group 41 has two pairs of signal wires 411 and a pair of grounding wires 412. Wires of the second wire group 42 are power supply wires. The signal wires 411 are electrically and are respectively connected to bending portions 212, 213, 215, 216 of the second, the third, the fifth and the sixth signal terminals. The grounding wires 412 are electrically connected to the grounding terminal 37. Furthermore, the insulator 10 has a receiving slot 17 for receiving the grounding terminal 37, and a plurality of wire slots 18, 19 for locating the first wire group 41 and the second wire group 42. In addition, wires of the second wire ground 42 are electrically and are respectively connected to bending portions 33 of the power supply terminals 31. Thus, an excellent electrical connection between the signal terminal group 20, the power supply terminal group 30 and the cable 40 is obtained.

Figure 4:
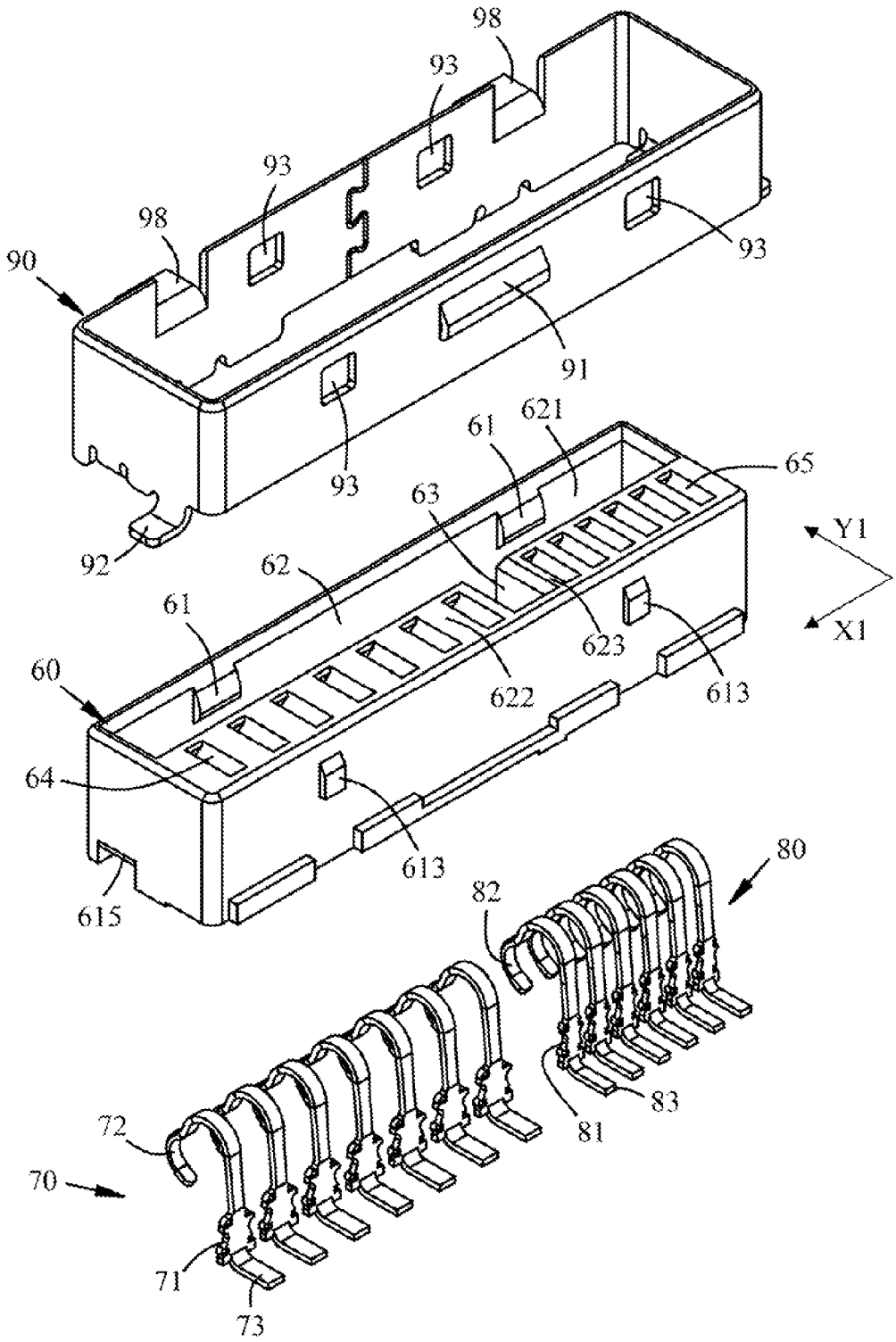
FIG. 4 is an exploded, three dimensional view of a second electrical connector of the present invention.
Figure 5:
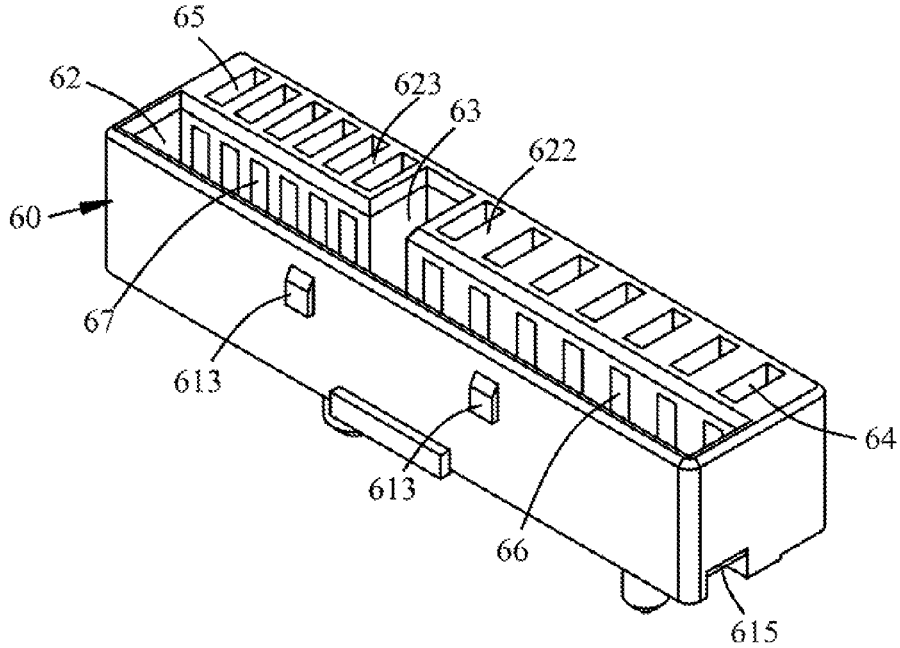
FIG. 5 is a schematic, three dimensional view of an insulator of the second electrical connector.

Referring to FIGS. 4 to 9, in the second embodiment of the present invention, the first electrical connector 1 is joined to a second electrical connector 2. The second electrical connector 2 includes an insulator 60, a signal terminal group 70, a power supply terminal group 80 and a metallic housing 90. The insulator 60 defines a lateral slot 62 with a first sidewall 621, a second sidewall 622 and a third sidewall 623 therein. A longitudinal guiding slot 63 extends from and communicates with the lateral slot 62. Both of the second and third sidewalls 622, 623 are oppositely spaced from the same first sidewall 621 only by the lateral slot 62 in a first direction Y1, and both of the second and third sidewalls 622, 623 are oppositely spaced from each other only by the longitudinal guiding slot 63 in a second direction X1 perpendicular to the first direction Y1. The signal terminal group 70 has a plurality of signal terminals 71, and each signal terminal 71 is inserted into a signal terminal hole 64 arranged on the second sidewall 622 of the insulator 60. The power supply terminal group 80 has a plurality of power supply terminals 81, and each power supply terminal 81 is inserted into a power supply terminal hole 65 arranged on the third sidewall 623 of the insulator 60. As FIG. 5 shows, the guiding slot 63 is located between the signal terminal holes 64 and the power supply terminal holes 65. The metallic housing 90 covers around the insulator 60. The metallic housing 90 has a locating projection 91 at a front end, and a supporting portion 98 at a rear end. Resilient portions 72 of the signal terminals 71 protrude beyond internal signal terminal slots 66 formed beside the second sidewall 622 of the insulator 60, for contacting with the flat portions 22 of the signal terminals 21 of the first electrical connector 1. Resilient portions 82 of the power supply terminal 81 protrude beyond internal power supply slots 67 formed beside the third sidewall 623 of the insulator 60, for contacting with the flat portions 32 of the power supply terminals 31 of the first electrical connector 1. The metallic housing 90 has a plurality of fastening plates 95 for respectively clasping in indentations 615 of the insulator 60. The insulator 60 has a plurality of blocking portions 613 for respectively received in fixing holes 93 of the metallic housing 90. Thus, when the first electrical connector 1 is disposed to the second electrical connector 2, the longitudinal guiding slot 63 guides the longitudinal guiding portion 13 of the first electrical connector 1, resulting the lateral rib 12 of the first electrical connector 1 be accurately inserted into the lateral slot 62. The grounding plates 52 of the first electrical connector 1 contact with the metallic housing 90 of the second electrical connector 2. The fixing plate 51 of the first electrical connector 1 is clasped to the locating projection 91 of the second electrical connector 2. The supporting portion 98 of the second electrical connector 2 supports the first electrical connector 1. Therefore, when the first electrical connector 1 is pulled out from the second electrical connector 2, the first electrical connector 1 and the second electrical connector 2 are prevented from being damaged.

Referring to FIG. 4, in the signal terminal group 70 and the power supply terminal group 80, the width of the power supply terminal 81 is smaller than the width of the signal terminal 71, and a distance between adjacent power supply terminals 81 is smaller than a distance between adjacent signal terminals 71, for further minimizing the width of the second electrical connector 2.

Figure 6:
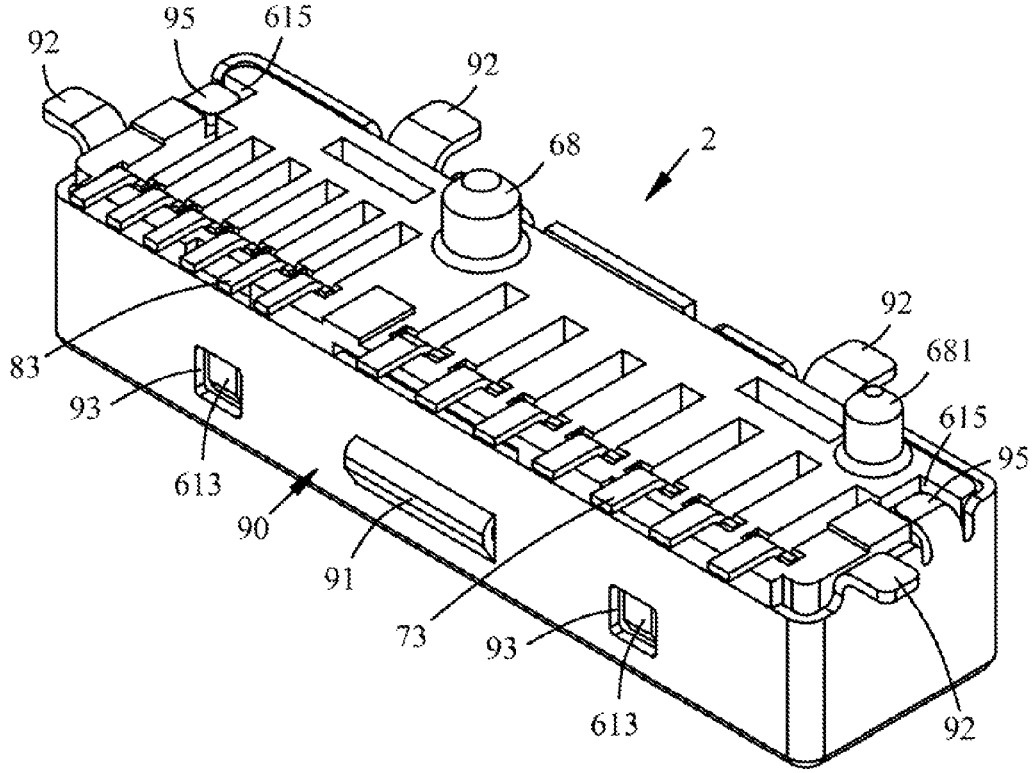
FIG. 6 is a three dimensional view of the second electrical connector but viewed from another aspect.
Figure 7:
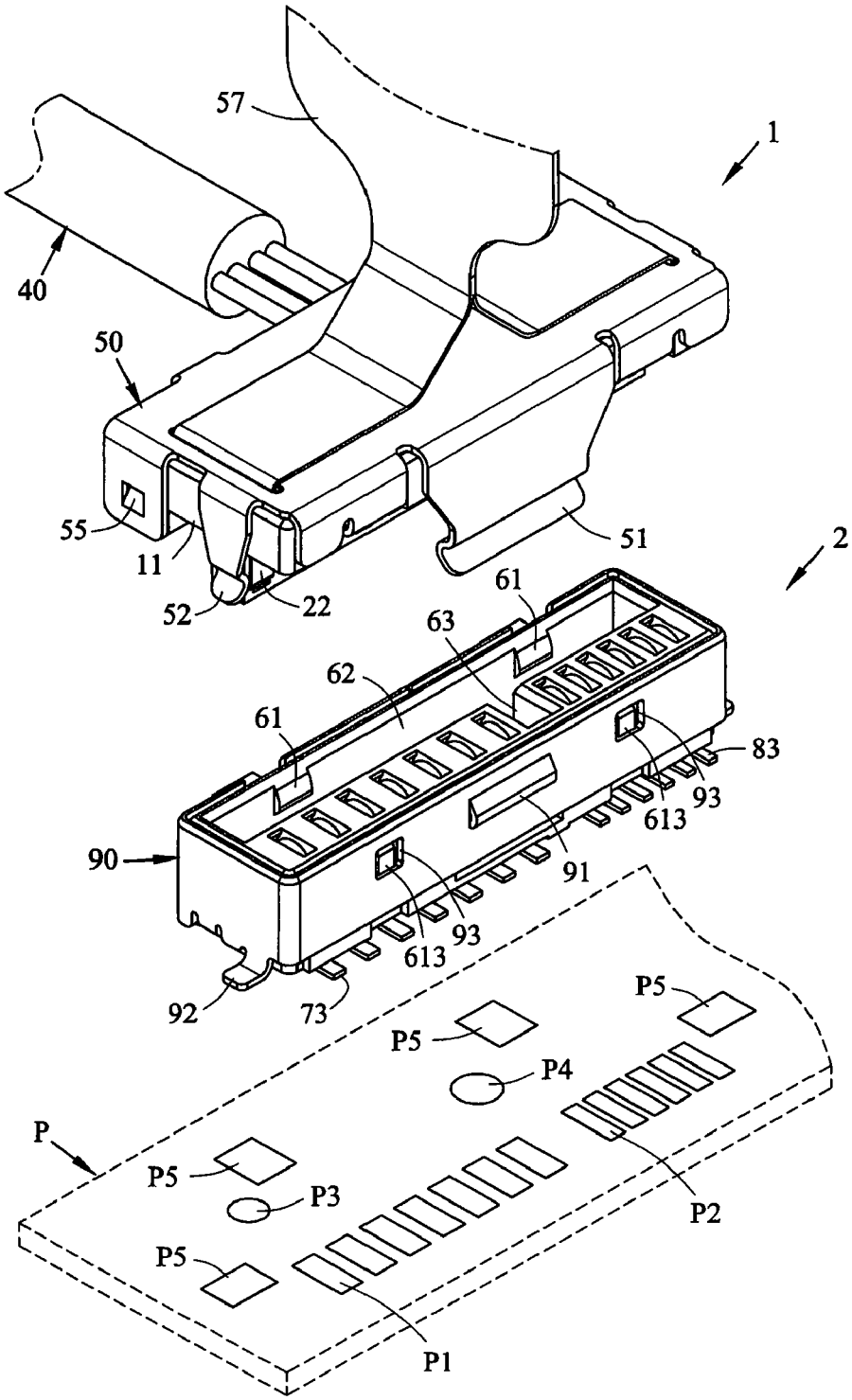
FIG. 7 is a three dimensional view shown an unassembled state of the first and the second electrical connectors.

Referring to FIGS. 6 and 7, bending portions 73, 83 of the signal terminals 71 and the power supply terminals 81 are respectively welded to conductive portions P1, P2 of a printed circuit board P. The insulator 60 has a plurality of locating posts 68, 681 for being inserted into locating holes P3, P4 of the printed circuit board P. The metallic housing 90 has a plurality of bending portions 92 for being respectively welded to conductive portions P5 of the printed circuit board P.

Figure 8:
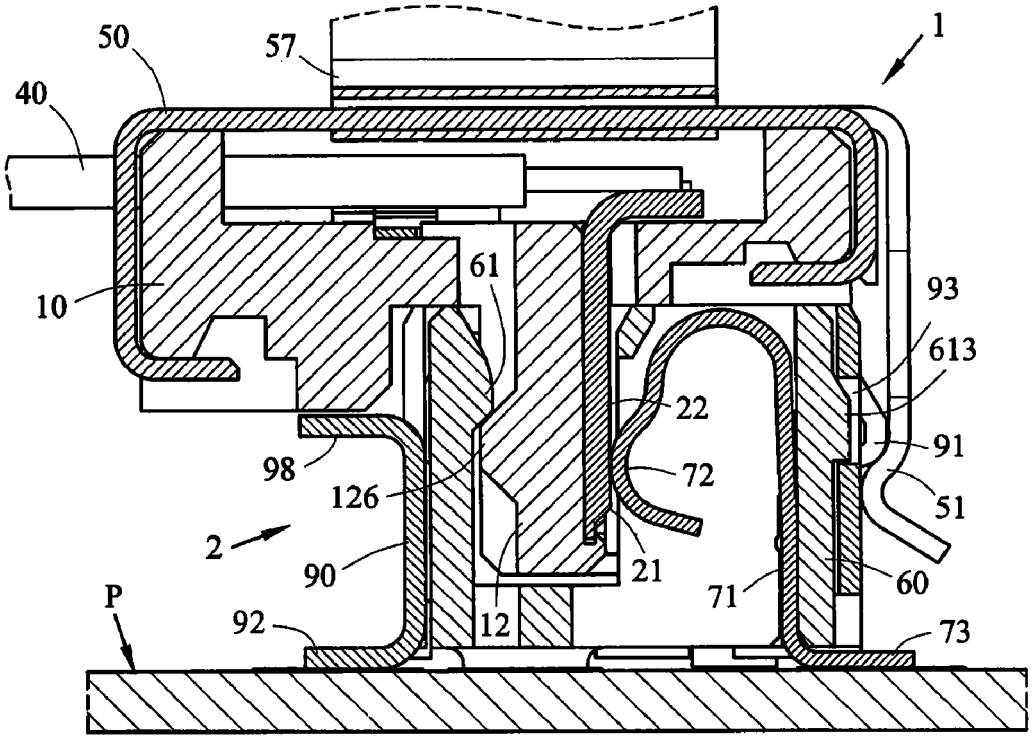
FIG. 8 is a three dimensional view shown an assembly state of the first and the second electrical connectors.

Referring to FIG. 8, the lateral rib 12 of the first electrical connector 1 has a locating block 126 at a rear side and an inner side surface of the insulator 60 of the second electrical connector 2 has a locating block 61 corresponding to the locating block 126. When the first electrical connector 1 is disposed to the second electrical connector 2, the locating block 61 limits the position of the locating block 126, resulting the first electrical connector 1 and the second electrical connector 2 have a steady connection.

Figure 9:
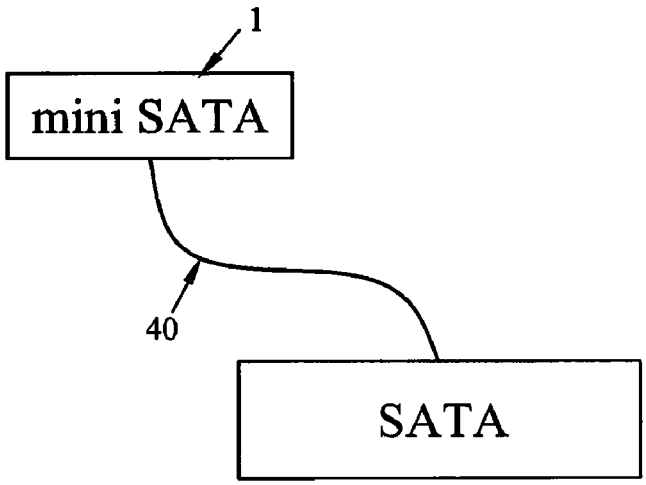
FIG. 9 is a schematic view shown a usage state of the first electrical connector.

Referring to FIG. 9, in the third embodiment of the present invention, the other end of the cable 40 of the first electrical connector 1 is electrically connected to a standard SATA electrical connector 3, cooperatively forming a transfer cable with a mini SATA electrical connector and a standard SATA electrical connector, facilitating connections between two electronic products.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A SATA electrical connector comprising:

an insulator defining a lateral slot and a longitudinal guiding slot extending from the lateral slot, wherein the lateral slot has a first sidewall, a second sidewall and a third sidewall, both of the second and third sidewalls are oppositely spaced from the same first sidewall only by the lateral slot in a first direction, and both of the second and third sidewalls are oppositely spaced from each other only by the longitudinal guiding slot in a second direction perpendicular to the first direction;

a signal terminal group having a plurality of signal terminals, the signal terminals being inserted into signal terminal holes of the insulator;

a power supply terminal group having a plurality of power supply terminals, the power supply terminals being inserted into power supply terminal holes of the insulator, wherein the signal terminal holes are arranged on the second sidewall and the power supply terminal holes are arranged on the third sidewall so that the guiding slot is located between the signal terminal holes and the power supply terminal holes; and a metallic housing covering around the insulator, the metallic housing having a supporting portion, wherein resilient portions of the signal terminals protrude beyond internal signal terminal slots formed beside the second sidewall of the insulator, resilient portions of the power supply terminal protrude beyond internal power supply slots formed beside the third sidewall of the insulator.

2. The SATA electrical connector according to claim 1, wherein the width of the power supply terminal is smaller than the width of the signal terminal.

3. The SATA electrical connector according to claim 1, wherein a distance between adjacent power supply terminals is smaller than a distance between adjacent signal terminals.

4. The SATA electrical connector according to claim 1, wherein the metallic housing has a locating projection at a front end, and an inner side surface of the insulator has a locating block.

5. The SATA electrical connector according to claim 1, wherein the insulator has a plurality of locating posts, the metallic housing has a plurality of bending portions and a plurality of fastening plates, the fastening plates respectively clasp in indentations of the insulator, the insulator has a plurality of blocking portions, the blocking portions are respectively received in fixing holes of the metallic housing.

6. A SATA electrical connector assembly comprising a first electrical connector with a cable and a second electrical connector disposed on a printed circuit board, insulators of the first and the second electrical connectors inserted a plurality of terminals, terminals of the first electrical connector being electrically connected to wires of the cable, terminals of the second electrical connector being electrically connected to conductive portions of the printed circuit board, wherein:

the insulator of the first electrical connector has a lateral rib and a longitudinal guiding portion extending from one side of the lateral rib, the terminals of the first electrical connector includes a first terminal group and a second terminal group, the guiding portion is located between the first terminal group and the second terminal group, the lateral rib is disposed to a lateral slot of the second electrical connector, and the longitudinal guiding portion is disposed to a longitudinal guiding slot of the second electrical connector which is extended from the lateral slot, wherein the lateral slot of the second electrical connector has a first sidewall, a second sidewall and a third sidewall, both of the second and third sidewalls are oppositely spaced from the same first sidewall only by the lateral slot in a first direction, and both of the second and third sidewalls are oppositely spaced from each other only by the longitudinal guiding slot in a second direction perpendicular to the first direction;

the flat portions of the terminals of the first electrical connector protrude beyond terminal slots of the lateral rib, and the flat portions contact with the terminals of the second electrical connector; and the metallic housing of the first electrical connector has a fixing plate, the fixing plate is clasped to a locating projection of the metallic housing of the second electrical connector, the metallic housing of the second electrical connector has a supporting portion.

7. The SATA electrical connector assembly according to claim 6, wherein the metallic housing of the first electrical connector has at least a grounding plate, the grounding plate contacts with the metallic housing of the second electrical connector.

8. The SATA electrical connector assembly according to claim 6, wherein the lateral rib of the first electrical connector has a locating block and an inner side surface of the insulator of the second electrical connector has a locating block corresponding to the locating block of the first electrical connector, the terminals of the second electrical connector are respectively welded to conductive portions of the printed circuit board, the insulator of the second electrical connector has a plurality of locating posts for being inserted into locating holes of the printed circuit board, the metallic housing of the second electrical connector has a plurality of bending portions for being respectively welded to conductive portions of the printed circuit board.

* * * * *